US009246206B2

(12) United States Patent
Park et al.

(10) Patent No.: US 9,246,206 B2
(45) Date of Patent: Jan. 26, 2016

(54) TRANSMISSION-LINE TRANSFORMER IN WHICH SIGNAL EFFICIENCY IS MAXIMISED

(75) Inventors: Jong Hoon Park, Incheon (KR); Chang Kun Park, Suwon-si (KR)

(73) Assignee: Soongsil University Research Consortium Techno-Park, Seoul (KR)

( * ) Notice: Subject to any disclaimer, the term of this patent is extended or adjusted under 35 U.S.C. 154(b) by 356 days.

(21) Appl. No.: 13/824,012

(22) PCT Filed: Sep. 7, 2011

(86) PCT No.: PCT/KR2011/006593

§ 371 (c)(1),
(2), (4) Date: Mar. 15, 2013

(87) PCT Pub. No.: WO2012/036403

PCT Pub. Date: Mar. 22, 2012

(65) Prior Publication Data

US 2013/0187745 A1 Jul. 25, 2013

(30) Foreign Application Priority Data

Sep. 15, 2010 (KR) ..... 10-2010-0090506

(51) Int. Cl.
*H01P 5/12* (2006.01)
*H01F 19/00* (2006.01)
(Continued)

(52) U.S. Cl.
CPC ..... *H01P 5/12* (2013.01); *H01F 17/0006* (2013.01); *H01F 19/00* (2013.01); *H01P 5/04* (2013.01); *H01P 5/10* (2013.01)

(58) Field of Classification Search
CPC ..... H01P 5/10; H01P 5/12; H01P 5/16; H01P 5/18; H01P 5/184; H01F 17/0006
USPC ..... 333/24 R, 25, 26, 204, 177, 238
See application file for complete search history.

(56) References Cited

U.S. PATENT DOCUMENTS 6,285,273 B1 * 9/2001 Morikawa ..... H01P 5/10 333/26
7,274,267 B2 * 9/2007 Saitou et al. ..... 333/26
(Continued)

FOREIGN PATENT DOCUMENTS

KR 10-0656335 B1 12/2006
KR 10-2007-0105936 A * 10/2007
(Continued)

*Primary Examiner* — Dean Takaoka
*Assistant Examiner* — Alan Wong
(74) *Attorney, Agent, or Firm* — Paratus Law Group, PLLC

(57) ABSTRACT

Provided is a transmission line transformer having increased signal efficiency. The transmission line transformer is formed on an integrated circuit (IC), wherein a first transmission line disposed in one direction. Second and third transmission lines have same length direction as the first transmission line and are spaced apart from each other in a lateral direction above or below the first transmission line. Accordingly, an area of the first transmission line and areas of the second and third transmission lines, which face each other, are increased, thereby improving a coupling factor. Also, since a secondary transmission line is divided into two regions and uses the second and third transmission lines that have narrower widths than the first transmission line, parasitic capacitance components generated between the first through third transmission lines and a semiconductor substrate may be decreased.

8 Claims, 4 Drawing Sheets

(51) Int. Cl.

| | |
|---|---|
| ***H01P 5/10*** | (2006.01) |
| ***H01F 17/00*** | (2006.01) |
| ***H01P 5/04*** | (2006.01) |

(56) References Cited

U.S. PATENT DOCUMENTS

| | | | | |
|---|---|---|---|---|
| 7,302,249 | B1 * | 11/2007 | Fudem et al. | 455/327 |
| 7,397,328 | B2 * | 7/2008 | Yasuda | H01P 5/10 333/204 |
| 7,548,134 | B2 | 6/2009 | Park et al. | |
| 7,592,865 | B2 | 9/2009 | Hong et al. | |
| 7,936,234 | B2 * | 5/2011 | Wu | H01P 5/10 333/26 |
| 8,786,381 | B2 * | 7/2014 | Kimball | H01F 27/2804 333/238 |
| 2006/0232355 | A1 | 10/2006 | Park et al. | |
| 2009/0009241 | A1 | 1/2009 | Hong et al. | |

FOREIGN PATENT DOCUMENTS

| | | | |
|---|---|---|---|
| KR | 10-2007-0105936 | A | 10/2007 |
| KR | 10-2008-0025533 | A | 3/2008 |
| KR | 10-2008-0045890 | A | 5/2008 |

* cited by examiner

-Prior Art-

-Prior Art-

-Prior Art-

TRANSMISSION-LINE TRANSFORMER IN WHICH SIGNAL EFFICIENCY IS MAXIMISED

CROSS REFERENCE TO PRIOR APPLICATION

This application is a National Stage Patent Application of PCT International Patent Application No. PCT/KR2011/006593 (filed on Sep. 7, 2011) under 35 U.S.C. §371, which claims priority to Korean Patent Application No. 10-2010-0090506 (filed on Sep. 15, 2010), which are all hereby incorporated by reference in their entirety.

TECHNICAL FIELD

The present invention relates to a transmission line transformer having increased signal efficiency, and more particularly, to a transmission line transformer formed on a semiconductor substrate in a high-frequency integrated circuit (IC) and whose signal efficiency is increased by improving a coupling factor.

BACKGROUND ART

A transformer that is one of common devices used in a high-frequency integrated circuit (IC) for a wireless communication system is used to convert impedance or combine electric powers. FIG. 1 is a diagram of a conventional transmission line transformer, wherein a primary transmission line 110 and a secondary transmission line 120 are formed on a semiconductor substrate. Also, primary ports 130-1 and 130-2 are connected to each end of the primary transmission line 110 and secondary ports 140-1 and 140-2 are connected to each end of the secondary transmission line 120. Referring to a cross-sectional view 150 taken along a line A-A' of FIG. 1, an insulator is disposed between the semiconductor substrate and the primary and secondary transmission lines 110 and 120.

FIG. 2 is a diagram for describing a principle of the conventional transmission line transformer of FIG. 1, wherein when a current is supplied to the primary transmission line 110 in a direction shown in FIG. 2, a current is induced to the secondary transmission line 120 in an opposite direction. Also, if the conventional transmission line transformer is ideal and thus lossless, a current strength in the secondary transmission line 120 is the same as a current strength in the primary transmission line 110.

In the conventional transmission line transformer of FIG. 1, highest layer metal lines available in semiconductor processes are used for the primary and secondary transmission lines 110 and 120, because when a distance between a metal line forming a transmission line transformer and a semiconductor substrate is decreased, a parasitic capacitance component is generated between the metal line and the semiconductor substrate, and thus a signal power loss is generated on the semiconductor substrate due to a magnetic field generated in the metal line.

Also, the current (hereinafter, a secondary current) of the secondary transmission line 120 is induced by the current (hereinafter, a primary current) of the primary transmission line 110 according to a magnetic field formed around the secondary transmission line 120 of the conventional transmission line transformer by the primary current. Generally, a coupling factor is used as an index indicating the strength of the secondary current induced by the primary current, and in order to increase the coupling factor, the magnetic field formed by the primary current needs to largely affect the secondary transmission line 120 of the conventional transmission line transformer. Accordingly, the areas of the primary and secondary transmission lines 110 and 120 facing each other need to be increased. However, the areas may be increased by increasing lengths of the primary and secondary transmission lines 110 and 120, but a power loss may be generated in the conventional transmission line transformer due to parasitic resistance components of the metal lines generated accordingly.

FIG. 3 is a transmission line transformer suggested instead of the conventional transmission line transformer. Referring to a cross-sectional view 350 of the transmission line transformer of FIG. 3, a primary transmission line 310 and a secondary transmission line 320 are disposed in same locations of different layers on a semiconductor substrate. Accordingly, primary ports 330-1 and 330-2 connected to the primary transmission line 310 and secondary ports 340-1 and 340-2 connected to the secondary transmission line 320 are disposed in same locations of different layers.

Parasitic resistance components that are same as those generated in the conventional transmission line transformer of FIG. 1 are generated in the transmission line transformer of FIG. 3, but a coupling factor is largely increased as areas of the primary and secondary transmission lines 310 and 320 facing each other are increased. However, at this time, a highest layer metal line and a lower layer metal line are used, and thus a distance between a metal line and a semiconductor substrate is decreased. Accordingly, a signal power loss caused by the semiconductor substrate is increased more than the conventional transmission line transformer of FIG. 1. Also, since the areas of the primary and secondary transmission lines 310 and 320 facing each other are largely increased, the transmission line transformer sensitively reacts to a signal change or a surrounding environment change.

DETAILED DESCRIPTION OF THE INVENTION

Technical Problem

The present invention provides a transmission line transformer capable of improving a coupling factor by increasing an area of a primary transmission line and an area of a secondary transmission line facing each other while decreasing a signal power loss caused by a semiconductor substrate.

Technical Solution

According to an aspect of the present invention, there is provided a transmission line transformer formed on an integrated circuit (IC), the transmission line transformer including: a first transmission line disposed in one direction; and second and third transmission lines having same length direction as the first transmission line and spaced apart from each other in a lateral direction above or below the first transmission line.

Advantageous Effects

According to a transmission line transformer having increased signal efficiency of the present invention, a coupling factor may be increased as an area of a first transmission line and areas of second and third transmission lines, which face each other, are increased, and parasitic capacitance components generated between the first through third transmission lines and a semiconductor substrate may be decreased by using the second and third transmission lines, which have narrower widths than the first transmission line, as a secondary transmission line is divided into two regions. In addition, an economic effect of reduced manufacturing costs may be obtained since areas occupied by the first transmission lines may be decreased by 50% or more compared to when all transmission lines are disposed at same heights from a semiconductor substrate.

BEST MODE

Hereinafter, a transmission line transformer having increased signal efficiency according to one or more exemplary embodiments of the present invention will be described more fully with reference to accompanying drawings.

Figure 4:
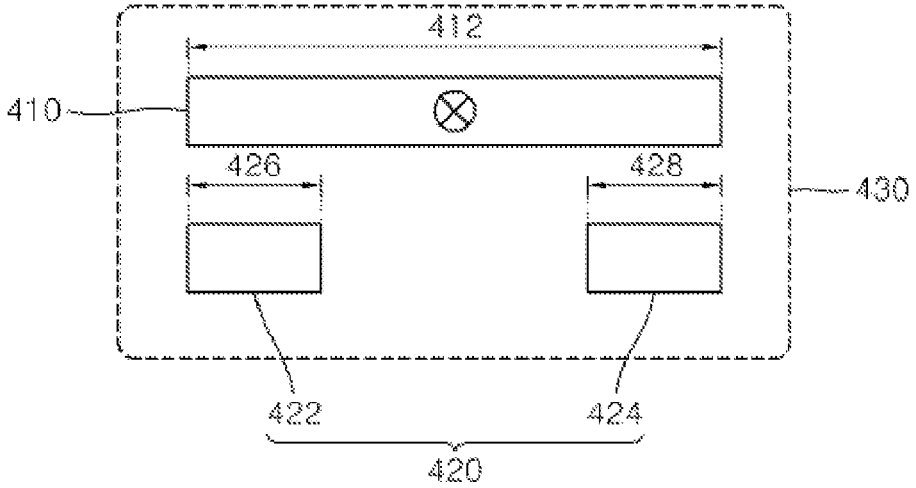
FIG. 4 is a diagram of a transmission line transformer having increased signal efficiency, according to an embodiment of the present invention.

FIG. 4 is a diagram of a transmission line transformer having increased signal efficiency, according to an embodiment of the present invention.

Referring to FIG. 4, the transmission line transformer is formed on an integrated circuit (IC) via semiconductor processes, and includes two types of transmission lines disposed above and below. FIG. 4 only illustrates a cross-sectional view 430, wherein the transmission line transformer is viewed from front, like the cross-sectional views 150 and 350 of FIGS. 1 and 3. The transmission line transformer includes a first transmission line 410 lengthily formed in one direction, and second and third transmission lines 422 and 424 disposed side by side below the first transmission line 410. In FIG. 4, the second transmission line 422 is disposed on left and the third transmission line 424 is disposed on right, but locations of the second and third transmission lines 422 and 424 may be switched.

Alternatively, the second and third transmission lines 422 and 424 may be disposed side by side above the first transmission line 410, but the transmission line transformer, wherein the second and third transmission lines 422 and 424 are disposed below the first transmission line 410 as shown in FIG. 4, will be mainly described.

The second and third transmission lines 422 and 424 have same heights from a semiconductor substrate, and length directions of the second and third transmission lines 422 and 424 are same as that of the first transmission line 410 denoted by in FIG. 4. A width 426 of the second transmission line 422 may be same as or different from a width 428 of the third transmission line 424, and since the second and third transmission lines 422 and 424 are spaced apart from each other as shown in FIG. 4, the widths 426 and 428 may be narrower than a width 412 of the first transmission line 410. Also, a sum of the widths 426 and 428 may be narrower than the width 412, thereby further decreasing parasitic capacitance components.

The second and third transmission lines 422 and 424 are connected to each other in parallel, and thus a same signal is input to each port of the second and third transmission lines 422 and 424 disposed in one direction, and a same signal is output from each port of the second and third transmission lines 422 and 424 disposed in another direction. Accordingly, the second and third transmission lines 422 and 424 operate as one transmission line separate from the first transmission line 410.

However, when the first transmission line 410 forms a primary transmission line and the second and third transmission lines 422 and 424 form a secondary transmission line, and the widths 426 and 428 of the second and third transmission lines 422 and 424 are different from each other, the second and third transmission lines 422 and 424 may not be connected in parallel and transmit signals to different locations. In other words, a transmission line having a wider width from among the second and third transmission lines 422 and 424 may transmit stronger signal than the signal of transmission line having a narrower width.

In the transmission line transformer of FIG. 4, left and right ends in a width direction perpendicular to the length direction of the first transmission line 410 respectively correspond to a left end of the second transmission line 422 and a right end of the third transmission line 424. Here, the width direction denotes a direction from the second transmission line 422 towards the third transmission line 424 or from the third transmission line 424 towards the second transmission line 422. In other words, when the transmission line transformer is viewed from the top, top regions of the second and third transmission lines 422 and 424 completely overlap a bottom region of the first transmission line 410, and the left and right ends of the first transmission line 410 in the width direction respectively match the ends of the second and third transmission lines 422 and 424.

Figure 5:
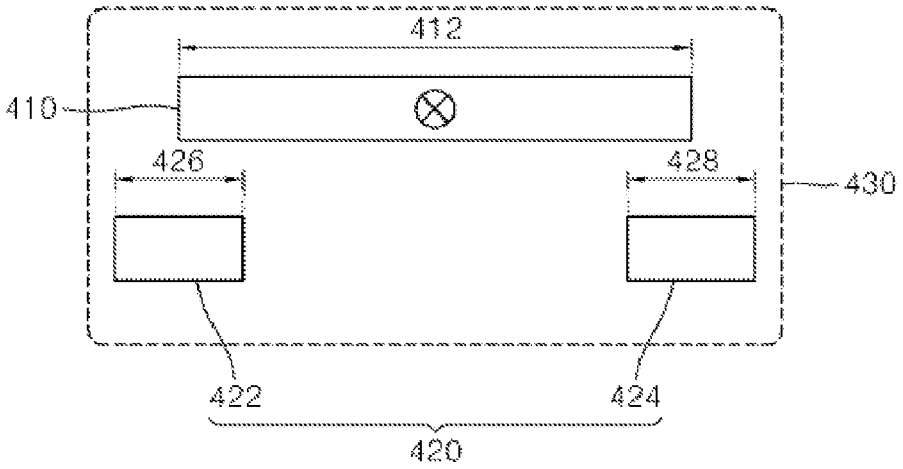
FIG. 5 is a diagram of a transmission line transformer having increased signal efficiency, according to another embodiment of the present invention.

Alternatively, some of top regions of the second and third transmission lines 422 and 424 may overlap a bottom region of the first transmission line 410. FIG. 5 is a diagram of a transmission line transformer having increased signal efficiency, according to another embodiment of the present invention. Referring to FIG. 5, like FIG. 4, the first transmission line 410 is disposed above and the second and third transmission lines 422 and 424 are formed in parallel below the first transmission line 410. However, unlike FIG. 4, the ends of the second and third transmission lines 422 and 424 do not match the left and right ends of the first transmission line 410, and when the transmission line transformer of FIG. 5 is viewed from the top, the left and right ends of the first transmission line 410 are disposed to be respectively within top regions of the second and third transmission lines 422 and 424.

A layout relationship of the first through third transmission lines 410, 422, and 424 described above may not only be applied when the first transmission line 410 is disposed above as shown in FIGS. 4 and 5, but also when the first transmission line 410 is disposed below. In other words, the left and right ends of the first transmission line 410 may be disposed to respectively match the left end of the second transmission line 422 and the right end of the third transmission line 424, or to be respectively within lower regions of the second and third transmission lines 422 and 424.

Meanwhile, the first through third transmission lines 410, 422, and 424 may form a primary transmission line and a secondary transmission line of the transmission line transformer. In other words, the first transmission line 410 may form a primary transmission line and the second and third transmission lines 422 and 424 may form a secondary transmission line 420. Alternatively, the first transmission line 410 may form a secondary transmission line and the second and third transmission lines 422 and 424 may form a primary transmission line.

Figure 1:
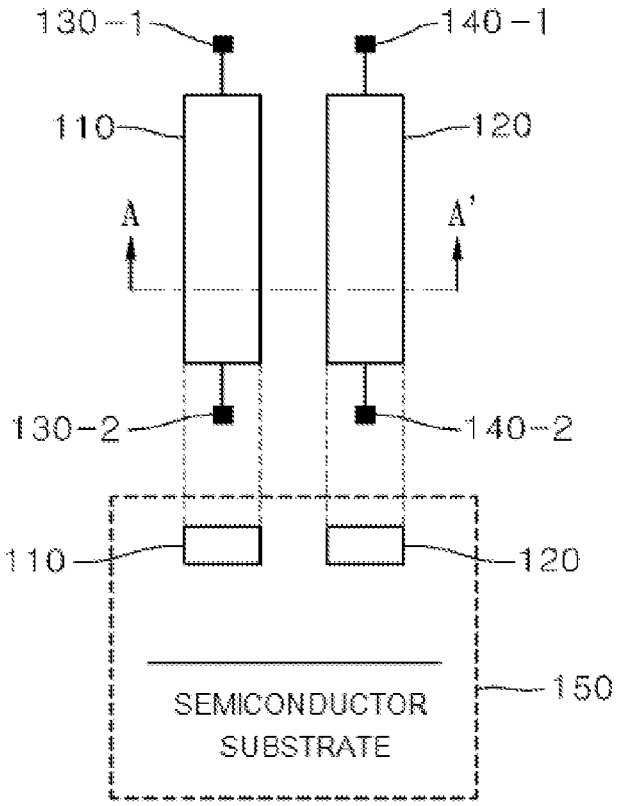
FIG. 1 is a diagram of a conventional transmission line transformer.

As the primary transmission line and the secondary transmission lines are disposed on different layers as described above, an area of the transmission line transformer may be decreased by 50% or more than an area of the conventional transmission line transformer of FIG. 1. An area of a transmission line transformer is related to costs, and the transmission line transformer according to an embodiment of the present invention has a reduced size as the primary transmission line and the secondary transmission line are disposed above and below, and thus manufacturing costs may be decreased.

Figure 6:
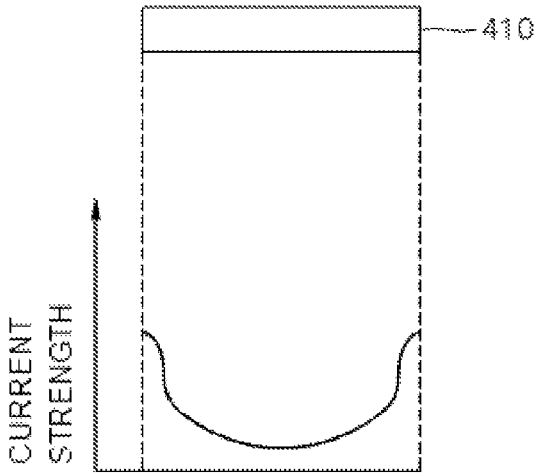
FIG. 6 is a diagram of a current distribution in a single transmission line like a first transmission line.

As described above, since the secondary transmission line 420 is divided into two regions, i.e., the second transmission line 422 and the third transmission line 424, and is disposed below the first transmission line 410, a coupling factor is improved. The improving of the coupling factor is related to a current distribution in a transmission line. FIG. 6 is a diagram of a current distribution in a single transmission line like the first transmission line 410. In FIG. 6, a current strength at ends of a transmission line is increased since a repulsive force is applied between charges forming the current.

Figure 2:
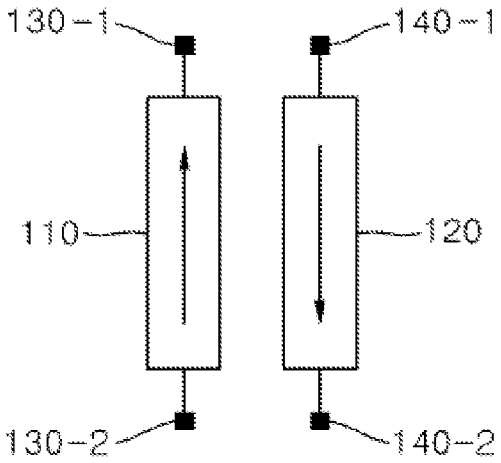
FIG. 2 is a diagram for describing a principle of the conventional transmission line transformer of FIG. 1.
Figure 7:
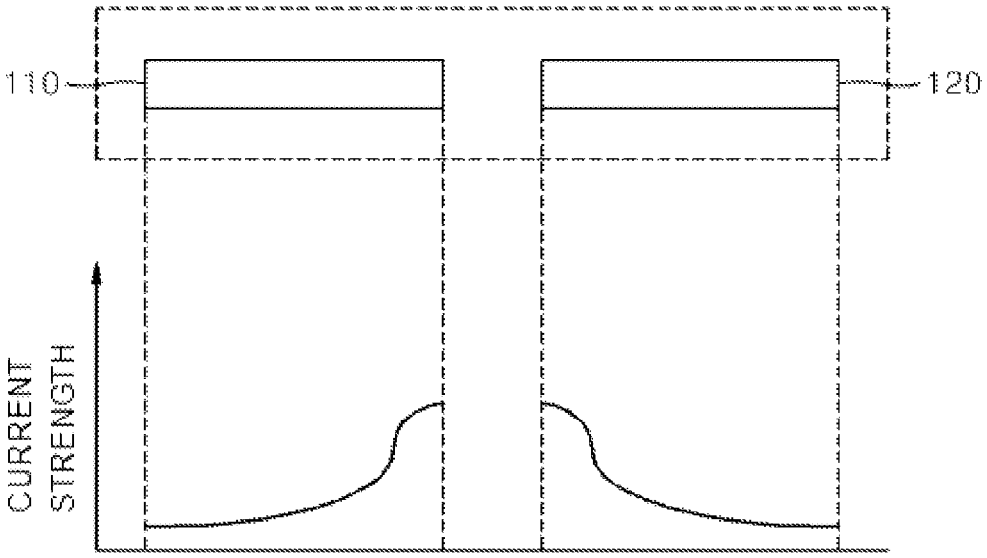
FIG. 7 is a diagram of current distributions in two transmission lines in the conventional transmission line transformer of FIG. 1.

FIG. 7 is a diagram of current distributions in the primary and secondary transmission lines 110 and 120 in the conventional transmission line transformer of FIG. 1. Here, current strengths at facing ends of the primary and secondary transmission lines 110 and 120, from among left and right ends, are increased since as shown in FIG. 2, directions of the currents in the primary and secondary transmission lines 110 and 120 are opposite.

Referring to the current distributions of FIGS. 6 and 7, in the transmission line transformer according to an embodiment of the present invention, since the second and third transmission lines 422 and 424 are disposed close to the left and right ends of the first transmission line 410, where the current strength is largest, a current flowing through an area of the first transmission line 410 and areas of the second and third transmission lines 422 and 424, which face each other, may be increased. Also, since the first transmission line 410 and the secondary transmission line 420 are disposed above and below and widths thereof are larger than thicknesses thereof, areas of the first transmission line 410 and the secondary transmission line 420, which face each other, are increased compared to the conventional transmission line transformer of FIG. 1, and thus the coupling factor is largely improved.

Figure 3:
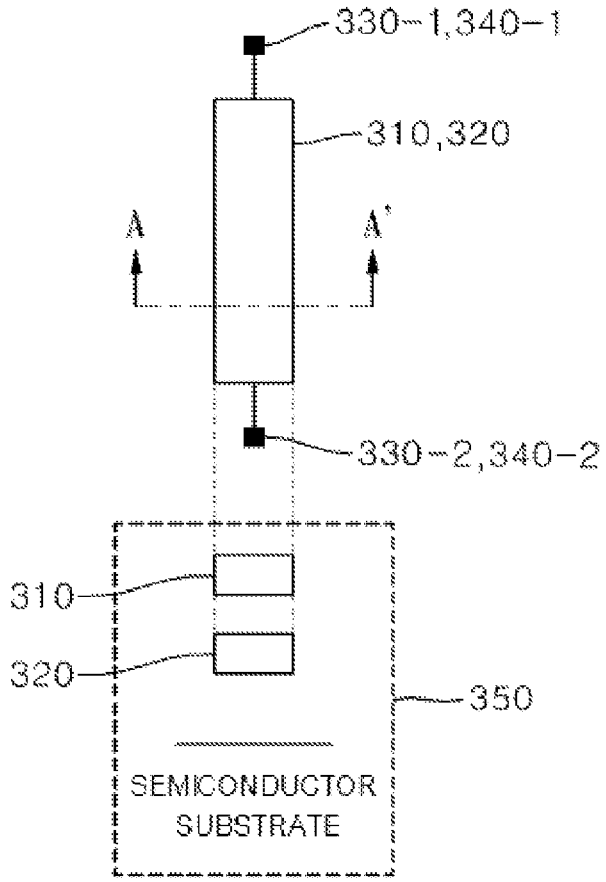
FIG. 3 is a transmission line transformer suggested instead of the conventional transmission line transformer.

On the other hand, since the areas of the first transmission line 410 and the secondary transmission line 420, which face each other, are not large compared to the conventional transmission line transformer of FIG. 3, the transmission line transformer according to an embodiment of the present invention may be prevented from being sensitive to a signal change, such as a frequency change, or a surrounding environment change.

In addition, since the second and third transmission lines 422 and 424 form the secondary transmission line 420, widths of the second and third transmission lines 422 and 424 are narrower than that of the secondary transmission line 320 of the conventional transmission line transformer of FIG. 3, and preferably, the sum of the widths 426 and 428 of the second and third transmission lines 422 and 424 may be narrower than the width 412 of the first transmission line 410. Accordingly, parasitic capacitance components generated between the semiconductor substrate and the first through third transmission lines 410, 422, and 424 may be decreased.

Meanwhile, if the transmission line transformer according to an embodiment of the present invention has a structure, wherein the first transmission line 410 is disposed below the second and third transmission lines 422 and 424, a parasitic capacitance component may be effectively suppressed when a top parasitic capacitance component is larger than a bottom parasitic capacitance component.

While the present invention has been particularly shown and described with reference to exemplary embodiments thereof, it will be understood by those of ordinary skill in the art that various changes in form and details may be made therein without departing from the spirit and scope of the present invention as defined by the following claims.

The invention claimed is:

1. A transmission line transformer formed on an integrated circuit (IC), the transmission line transformer comprising:

a first transmission line disposed in one direction; and second and third transmission lines having same length direction as the first transmission line and spaced apart from each other in a lateral direction above or below the first transmission line, wherein the second and third transmission lines are connected to each other in parallel such that a same signal is input to each port of the second and third transmission lines, wherein widths of the second and third transmission lines are different from each other.

2. The transmission line transformer of claim 1, wherein a width of the first transmission line is equal to a sum of the width of the second transmission line, the width of the third transmission line, and a distance between the second and third transmission lines.

3. The transmission line transformer of claim 2, wherein the first transmission line forms a primary transmission line and the second and third transmission lines form a secondary transmission line.

4. The transmission line transformer of claim 2, wherein the first transmission line forms a secondary transmission line and the second and third transmission lines form a primary transmission line.

5. The transmission line transformer of claim 1, wherein one end of the first transmission line in a width direction is disposed in a region between two ends of the second transmission line, and another end of the first transmission line in the width direction is disposed in a region between two ends of the third transmission line.

6. The transmission line transformer of claim 1, wherein the first transmission line forms a primary transmission line and the second and third transmission lines form a secondary transmission line.

7. The transmission line transformer of claim 6, wherein the second and third transmission lines transmit signals having different strength in proportion to the widths.

8. The transmission line transformer of claim 1, wherein the first transmission line forms a secondary transmission line and the second and third transmission lines form a primary transmission line.

* * * * *